US010370781B2

(12) United States Patent
Henssen et al.

(10) Patent No.: US 10,370,781 B2
(45) Date of Patent: Aug. 6, 2019

(54) ABRASION RESISTANT FABRIC

(71) Applicant: DSM IP ASSETS B.V., Heerlen (NL)

(72) Inventors: Giovanni Joseph Ida Henssen, Echt (NL); Guelfo Valerio Bagordo, Echt (NL); Flavio Berto, Echt (NL)

(73) Assignee: DSM IP ASSETS B.V., Heerlen (NL)

( * ) Notice: Subject to any disclaimer, the term of this patent is extended or adjusted under 35 U.S.C. 154(b) by 319 days.

(21) Appl. No.: 15/028,778

(22) PCT Filed: Nov. 4, 2014

(86) PCT No.: PCT/EP2014/073699
§ 371 (c)(1),
(2) Date: Apr. 12, 2016

(87) PCT Pub. No.: WO2015/071133
PCT Pub. Date: May 21, 2015

(65) Prior Publication Data

US 2016/0237598 A1 Aug. 18, 2016

(30) Foreign Application Priority Data

Nov. 12, 2013 (EP) ..... 13192506

(51) Int. Cl.
*D03D 11/00* (2006.01)
*D03D 1/00* (2006.01)
*D03D 15/00* (2006.01)

(52) U.S. Cl.
CPC ..... *D03D 11/00* (2013.01); *D03D 1/00* (2013.01); *D03D 1/0041* (2013.01); *D03D 15/00* (2013.01); *D03D 15/0027* (2013.01); *D10B 2201/02* (2013.01); *D10B 2211/02* (2013.01); *D10B 2321/022* (2013.01); *D10B 2321/0211* (2013.01); *D10B 2331/021* (2013.01); *D10B 2331/14* (2013.01); *D10B 2331/301* (2013.01)

(58) Field of Classification Search
CPC ..... D03D 11/00; D03D 1/00; D03D 10/041; D03D 15/00; D03D 15/0027
See application file for complete search history.

(56) References Cited

U.S. PATENT DOCUMENTS

| | | | | |
|---|---|---|---|---|
| 4,413,110 | A | 11/1983 | Kavesh et al. | |
| 4,748,996 | A | 6/1988 | Combier | |
| 2007/0249250 | A1 | 10/2007 | Servajean | |
| 2010/0075557 | A1 | 3/2010 | Shteiyer | |
| 2016/0201234 | A1* | 7/2016 | Khokar ..... | D03C 9/02 139/384 R |

FOREIGN PATENT DOCUMENTS

| | | |
|---|---|---|
| CN | 203 021 721 | 6/2013 |
| EP | 0 472 114 | 12/1985 |
| EP | 0 213 208 | 2/1986 |
| EP | 0 200 547 | 4/1986 |
| EP | 0 205 960 | 5/1986 |
| GB | 2 042 414 | 2/1980 |
| GB | 0 251 667 | 6/1980 |
| WO | WO 98/01047 | 1/1998 |
| WO | WO 2001/073173 | 10/2001 |
| WO | WO 2005/066401 | 7/2005 |

OTHER PUBLICATIONS

International Search Report for PCT/EP2014/073699 dated Jan. 15, 2015, four pages.
Written Opinion of the ISA for PCT/EP2014/073699 dated Jan. 15, 2015, eight pages.
T. Nakajima, "Advanced fiber spinning technology", *Woodhead Publ. Ltd.*, 1994, 21 pages.

* cited by examiner

*Primary Examiner* — Clinton T Ostrup
*Assistant Examiner* — Andrew Wayne Sutton
(74) *Attorney, Agent, or Firm* — Nixon & Vanderhye P.C.

(57) ABSTRACT

The invention relates to a woven fabric comprising a weft yarn and at most two warp yarns A and B, wherein the weft yarn comprises a high performance fiber; the warp yarn A comprises at least 50 wt % of a natural fiber; the warp yarn B comprises a high performance fiber; and wherein the fabric has an outside layer comprising the warp yarn A and an inside layer comprising the warp yarn B and said outside and inside layers being at least partially interconnected by the weft yarn. The invention also relates to products comprising said woven fabric such as clothing, lining, sport apparel, gloves, curtains, upholstery fabric and floor covering.

19 Claims, No Drawings

ABRASION RESISTANT FABRIC

This application is the U.S. national phase of International Application No. PCT/EP2014/073699 filed 4 Nov. 2014 which designated the U.S. and claims priority to EP Patent Application No. 13192506.7 filed 12 Nov. 2013, the entire contents of each of which are hereby incorporated by reference.

The invention relates to a woven fabric comprising high performance fibers and natural fibers. The invention also relates to the use of the fabric and to articles comprising the fabric such as clothing, sport apparel, gloves, curtains, upholstery fabric, floor covering and other applications of such a fabric.

Such a woven fabric is known from US2007/0249250. US2007/0249250 discloses a fabric comprising a weft yarn made of cellulose material and a warp yarn produced from a high performance fibre covered over at least 75% by a coating comprising natural fiber. The fabric has a concentration gradient of the warp yarn through the thickness of the fabric, being composed of an outer portion predominantly of warp yarn and an inner portion predominantly of the weft yarn. A fabric according to US2007/0249250 has good mechanical properties, in particular resistance to fire, and to abrasion but which are also comfortable to wear. US2010/0075557A1 discloses a woven fabric having a first surface and a second surface, the fabric comprising three warp systems that are interlaced with weft fibers. The first warp fibers may be aesthetic fibers, e.g. natural fibers, cotton, wool, rayon, polyamide fibers, high modulus fibers; the second wrap may be performance fibers, e.g. high molecular weight polyethylene, aramid, carbon fiber, fiberglass; the third wrap fibers include comfort providing qualities, e.g. cotton, rayon, wool, polyester, nylon. The weft fibers may be stretchable fibers and include Lycra® fibers, Spandex® fibers, Kevlar® fibers, high modulus polyethylene, wool, rayon, nylon, modeacrylic fibers.

However, the fabric of the prior art is difficult and expensive to manufacture since the warp yarn comprises a high performance fiber core and a helical wrapping of for example cotton covering at least 75% of the surface of the core. The manufacture of such warp yarn is a labor intensive and expensive process. Furthermore is such a covered yarn less robust during use and shows shift or integrity loss of the helical wrapping leading to heterogeneous appearance yarns and handling difficulties resulting in a loss of production or a reduced quality of the fabrics.

An aim of the present invention may thus be to provide a woven fabric which mitigates the above mentioned disadvantages and in particular is less affected by production losses or reduced quality while maintaining the wearing comfort of the fabric. A further aim of the invention may be to provide a woven fabric which can be manufactured from yarns that are more readily available since less labor intensive and having reduced manufacturing costs. A further aim of the invention may be to provide a fabric with improved abrasion properties and wearing comfort or with optimized balance between abrasion properties and wearing comfort, whereas the fabric is manufactured at reduced costs and process complexity.

The invention provides a woven fabric comprising a weft yarn and at most two warp yarns A and B, wherein the weft yarn comprises a high performance fiber; the warp yarn A comprises at least 50 wt % of a natural fiber; the warp yarn B comprises a high performance fiber; and wherein the fabric has an outside layer comprising the warp yarn A and an inside layer comprising the warp yarn B and said outside and inside layers being at least partially interconnected by the weft yarn.

It was observed that the woven fabric of the invention may show improved manufacturing efficiency through a more robust and/or cheaper yarn. It was further observed that the fabrics of the invention are less labor intensive to produce, while they may have an equal or improved resistance to abrasion and may have an equal or improved wearing comfort.

The fabric of the invention comprises at most two warp yarns, A and B, providing thus sufficient room for weaving flexibility to obtain improved abrasion resistance while keeping the manufacturing complexity but also the areal density and the material costs low.

By warp yarn is herein understood a multitude of yarns having the same composition, and may be also referred to as warp system. Each warp yarn runs substantially lengthwise, in the machine direction of the fabric. The fabric of the invention has at least two warp yarns which are distinguished by their mutual positions in the fabric. Such position within the fabric can be achieved by techniques commonly known in the field. For example can the multiple warp yarns be provided to the weaving process through beams with a warp yarn per beam but also via a single beam with the different warp yarns being organized next to each other. The use of separate beams for the different warp yarns may have the advantage of increased flexibility and improved weaving control. By the position of the warp yarns within the fabric is herein understood the respective position of warp yarn A and warp yarn B in relation through the thickness of the fabric. In this respect a fabric can be considered to be a three dimensional object wherein one dimension (the thickness) is much smaller than the two other dimensions (the length or the warp direction and the width or weft direction). In general, the length direction is only limited by the length of the warp yarns whereas the width of a fabric is mainly limited by the count of individual warp yarns and the width of the weaving machine employed. The position of the two warp yarns is defined according to their position across the thickness of the fabric, whereby the thickness is delimited by an outside and an inside surface. By 'outside' and 'inside' is herein understood that the fabric comprises two distinguishable surfaces. The terminology 'outside' and 'inside' should not be interpreted as a limiting feature rather than a distinction made between the two different surfaces. In many application of the fabric may the outside surface be oriented towards the external environment whereas the inside surface may be oriented towards the body to be protected from for example abrasion. Although such orientation may be preferred, it may as well be that for specific uses the surfaces will be facing the opposite way or that the fabric is folded to form a double layer fabric with two identical surfaces exposed on either side while the other surfaces are turned towards each other.

Accordingly, an outside and an inside layer are defined through the thickness of the fabric whereby the outside layer comprises the outside surface and the inside layer comprises the inside surface. Layers are defined to be volumes that extend substantially parallel to the respective fabric surfaces and having a thickness of 50% or less of the total thickness of the fabric.

In the context of the present application, the layer comprising the warp yarn A may be considered the outside layer whereas the layer comprising the warp yarn B may be considered the inside layer.

The weft yarn generally refers to the yarns that run in a cross-wise direction, transverse to the machine direction of the fabric. Defined by a weaving sequence of the fabric, each weft yarn repeatedly passes between two adjacent warp yarns, switching between the sides of the planes formed by the respective warp yarns A or B and results in interlacing or interconnection between said warp yarns but also between the outside and inside layers comprising said warp layers, respectively. The angle formed between the warp yarns and the weft yarn is preferably about 90°. The fabric may comprise one single weft yarn or multiple weft yarns with different composition. The weft yarn in the fabric according to the present invention can be one single weft yarn or a plurality of weft yarns. In the case that said fabric comprises a plurality of weft yarns, such yarns may have the same or different composition.

The weave structure formed by the warp yarns and the weft yarns can be of multiple types, depending upon the number and diameters of the employed warp yarns and weft yarns as well as on the weaving sequence used between the warp yarns and the weft yarns during the weaving process. Such different sequences are well known to the person skilled in the art. Through the weaving process the weft yarn interweaves the at most 2 warp yarns, A and B, hereby partially interconnecting the outside and inside layers comprising respectively said warp yarns, A and B. Such interweaved structure may also be called a monolayer fabric even though such monolayer may be composed of sub layers as described above.

Considering that a weave structure comprising at most two warp yarns and a weft yarn may result in rather complex weaves, the individual inside and outside layers may present, once the interwoven character via the weft yarn is disregarded, the typical weave structures for fabrics such as plain weave, twill weave and satin weave, but also other more complex weaves. Hereby an advantage of the weave structure of the fabric of the present invention is that both surfaces of the fabric may have distinguishable or the same weave structures independently selected from the weave structure of the other surface, which may be impossible for weaves consisting of only one warp and one weft yarn.

A weave structure is typically characterized by a float, a length of the float and a float ratio. The float is a portion of a weft yarn delimited by two consecutive points where the weft yarn crosses the virtual plane formed by the respective warp yarns A or B. The length of the float expresses the number of warp yarns that the float passes between said two delimiting points. Typical lengths of floats may be 1, 2 or 3, indicating that the weft yarn passes 1, 2 or 3 warp yarns before crossing the virtual plane formed by the warp yarns by passing between 2 adjacent warp yarns. The float ratio is the proportion between the lengths of the floats of the weft yarn on either side of the plane formed by the warp yarns. Preferably the weave structure of the outside layer has a float ratios are 3/1, 2/1 or 1/1, most preferably the float ratio is 3/1 resulting in a Jeans aspect of the outside layer. The weave structure for the inside layer may be chosen independent form the outside layer and be optimized for improved abrasion resistance or wear comfort. Depending upon the composition of the warp yarn B and the weft yarn the weave structure of the inside layer has a float ratios are 3/1, 2/1 or 1/1, most preferably the float ratio is 1/1.

By 'at least partially interconnected' is meant herein that the ratio between the number of crossings a weft yarn performs through the virtual plane formed by the warp yarn A to the number of crossings said weft yarn performs through the virtual plane formed by the warp yarn B is at most 4:1, preferably at most 3:1, more preferably at most 2:1, and most preferably at most 1:1. 'At least partially interconnected' may be also referred herein interchangeably as 'interconnected'.

By 'fiber' is herein understood an elongated body having a length, a width and a thickness, the length dimension of which is much greater than its transverse dimensions of width and thickness. The term fiber also includes various embodiments e.g. a filament, a ribbon, a strip, a band, a tape and the like having regular or irregular cross-sections. The fibers may have continuous lengths, known in the art as filaments, or discontinuous lengths, known in the art as staple fibers. Natural fibers typically are staple fibers but staple synthetic fibers are commonly obtained by cutting or stretch-breaking filaments of corresponding synthetic fibers. The fibers may have various cross-sections, e.g. regular or irregular cross-sections with a circular, bean-shape, oval or rectangular shape. A yarn for the purpose of the invention is an elongated body containing a plurality of fibers. The skilled person may distinguish between continuous filament yarns or filament yarns which contain many continuous filament fibers and staple yarns or spun yarns containing short fibers also called staple fibers.

The at most two warp yarns (A and B) may further be distinguished by their yarn composition. Accordingly, the warp yarn A comprises at least 50 wt % of a natural fiber, preferably at least 75 wt % of a natural fiber, more preferably at least 90 wt % of a natural fiber. Most preferably, the warp yarn A substantially consists of a natural fiber. In the context of the present application natural fibers are understood to be naturally occurring fibres such as cotton, wool, silk, jute, cocos, linen and the like. Fabrics with appealing texture and haptic properties are obtained where the natural fiber of the warp yarn A in the fabric according to the present invention is cotton or wool.

In the context of the present invention, the expression 'substantially consisting of' has the meaning of 'may comprise traces of further species' or in other words 'comprising more than 98 wt % of' and hence allows for the presence of up to 2 wt % of further species.

The warp yarn A may further contain synthetic fibers of e.g. polyamides, polyesters, polytetrafluoroethylene, polyolefins, polyvinyl alcohols and polyacrylonitriles; and/or high performance fibers; and/or other natural fibers than cotton, hemp, wool, silk, jute, linen.

In the context of the present invention, high performance fibers are understood to include fibers comprising or consisting of a polymer selected from a group comprising polyolefins, polyoxymethylene; poly(vinylidine fluoride); poly(methylpentene); poly(ethylene-chlorotrifluoroethylene); polyamides and polyaramides, e.g. poly(p-phenylene terephthalamide) (known as Kevlar®); polyarylates; poly (tetrafluoroethylene) (PTFE); poly{2,6-diimidazo-[4,5b-4', 5'e]pyridinylene-1,4(2,5-dihydroxy)phenylene} (known as M5); poly(p-phenylene-2,6-benzobisoxazole) (PBO) (known as Zylon®); poly(hexamethyleneadipamide) (known as nylon 6,6); polybutene; polyesters, e.g. poly (ethylene terephthalate), poly(butylene terephthalate), and poly(1,4 cyclohexylidene dimethylene terephthalate); polyvinyl alcohols and thermotropic liquid crystal polymers (LCP) as known from e.g. U.S. Pat. No. 4,384,016. Preferably, the high performance fibers comprise or consist of thermoplastic polymers. Preferably, the high performance fibers comprise or consist of semicrystalline polymers. Also combinations of fibers comprising the above referred polymers can be used in the fabric according to the present invention.

Alternatively, high performance fibers may be understood herein to include fibers, preferably polymeric fibers, having a tenacity or tensile strength of at least 1.2 N/tex, more preferably at least 2.5 N/tex, most preferably at least 3.5 N/tex, yet most preferably at least 4 N/tex. For practical reasons, the tenacity or tensile strength of the high performance fibers may be at most 10 N/tex. The tensile strength may be measured by the method as described in the "Examples" section herein below.

Preferably, the fabric according to the present invention comprises polyolefin fibers. More preferably, the polyolefin fibres comprise propylene and/or ethylene homopolymers and/or propylene and/or ethylene based copolymers. Even more preferably, the polyolefin is a polyethylene, more preferably a medium, high or ultrahigh molecular weight polyethylene and most preferably, an ultrahigh molecular weight polyethylene (UHMWPE). By UHMWPE is herein understood a polyethylene having an intrinsic viscosity (IV) of at least 4 dl/g, more preferably at least 8 dl/g, most preferably at least 12 dl/g. Preferably said IV is at most 40 dl/g, more preferably at most 30 dl/g, more preferably at most 25 dl/g. The IV may be determined according to ASTM D1601(2004) at 135° C. in decalin, the dissolution time being 16 hours, with BHT (Butylated Hydroxy Toluene) as anti-oxidant in an amount of 2 g/l solution, by extrapolating the viscosity as measured at different concentrations to zero concentration. Preferably, the UHMWPE fibers are gel-spun fibers, i.e. fibers manufactured with a gel-spinning process. Examples of gel spinning processes for the manufacturing of UHMWPE fibers are described in numerous publications, including EP 0205960 A, EP 0213208 A1, U.S. Pat. No. 4,413,110, GB 2042414 A, GB-A-2051667, EP 0200547 B1, EP 0472114 B1, WO 01/73173 A1, EP 1,699,954 and in "*Advanced Fibre Spinning Technology*", Ed. T. Nakajima, Woodhead Publ. Ltd (1994), ISBN 185573 182 7.

Preferably, the high performance fibers in the present invention are polyethylene fibers, more preferably UHMWPE fibers having a tenacity of at least 2 N/tex, more preferably at least 3 N/tex.

Preferably, the warp yarn A comprises between 0.5 and 50 wt % of a high performance fiber, more preferably between 1 and 20 wt %, even more preferred between 2 and 10 wt % of a high performance fiber. A low amount of high performance fiber present in the warp yarn A further improves the abrasion resistance of the fabric of the invention.

In a further preferred embodiment, the high performance fiber present in the warp yarn A is a high performance fiber chosen from the group of polyaramides fibers and polyolefin, preferably polyethylene and most preferably UHMWPE fibers. It was observed that when the warp yarn A of the weave comprises high performance fibers, more in particular high performance aromatic polyamide or polyolefin fibers, more in particular poly(p-phenylene terephthalamide) or ultrahigh molecular weight polyethylene fibers, the weave has further improved abrasion resistance.

The warp yarn B present in the inside layer of the fabric of the present invention comprises a high performance fiber according to the definition of a high performance fiber as defined herein. Preferably, the warp yarn B comprises at least 1 wt % high performance fiber, preferably at least 5 wt %, more preferably at least 15 wt %, more preferably at least 30 wt %, even more preferably at least 50 wt %, even more preferably at least 75 wt % and most preferably at least 90 wt % of high performance fiber. It was observed that increasing levels of high performance fibers in the warp yarn B further improve the abrasion resistance of the fabric, while wearing comfort and appearance of the fabric are only mildly if at all affected.

Although further improved abrasion properties of the fabric are obtained by using higher amounts of high performance fibers in the warp yarn B, it was observed that the wearing comfort of the fabric according to the invention is further improved by a warp yarn B comprising at least one fiber selected from the group comprising cotton, hemp, wool, silk, jute, linen and synthetic fibers of polyamides, polytetrafluoroethylene, polyesters, polyolefins, polyvinyl alcohols and polyacrylonitriles.

It was surprisingly observed that wearing comfort and abrasion resistance of the fabric is further improved or their balance is optimized with the warp yarn B being a spun yarn. It appears that the spun character of the warp yarn B has only a limited effect on the abrasion resistance, whereas its more natural texture provides a more natural feeling to the wearer. A further advantage is that the composition of a spun yarn can easily be adjusted to any desired ratio that allows further improvement or optimization of the abrasion and comfort. In a preferred embodiment, the spun yarn substantially consists of high performance fiber, more preferably of UHMWPE staple fibers.

The spun yarn may be manufactured by any technique known in the art such as ring spinning process or open-end spinning process. An advantage of applying the ring spinning process is that the mechanical treatment and process temperature are more suitable if for example UHMWPE staple fibers are spun, while the open-end spinning process with higher productivity can be applied in case high temperature resistant staple yarns with only minor amounts of UHMWPE are present in the blends.

The weft yarn comprised in the fabric of the present invention comprises a high performance fiber according to the definition of a high performance fiber as refer to herein. In a more preferred embodiment, the weft yarn comprises at least 10 wt % high performance fiber, more preferably at least 25 wt %, even more preferably at least 50 wt %, even more preferably at least 75 wt %, even more preferably at least 90 wt % and most preferably 100 wt % of high performance fiber. Surprisingly it was observed that increasing levels of high performance fibers in the weft yarn is beneficial to the abrasion resistance of the fabric while wearing comfort and appearance of the fabric remain practically unaffected.

It was observed that when the weft yarn of the weave comprises high performance fibers, more in particular high performance aromatic polyamide or polyolefin fibers, more in particular poly(p-phenylene terephthalamide) or ultrahigh molecular weight polyethylene fibers, the fabric may have further improved abrasion resistance or may be produced at a higher speed. Hence, in a preferred embodiment the high performance fiber present in the weft yarn is a high performance fiber chosen from the group consisting of aromatic polyamide fibers and UHMWPE fibers.

Although further improved abrasion properties of the fabric are obtained by higher amounts of high performance fibers in the weft yarn, it was observed that the wearing comfort of the fabric according to the invention may be further improved by a weft yarn comprising at least one fiber selected from the group comprising cotton, hemp, wool, silk, jute, linen and synthetic fibers of polyamides, polytetrafluoroethylene, polyesters, polyolefins, polyvinyl alcohols and polyacrylonitriles.

It was surprisingly observed that the abrasion resistance of the fabric is further increased or optimized by with the weft yarn being a continuous filament yarn. It appears that the continuous filament character of the weft yarn B further enhances the abrasion resistance. In a preferred embodiment, the weft yarn is a continuous filament yarn of UHMWPE filaments, aromatic polyamide filaments or combinations thereof.

It was further observed that specific types of high performance fibers present in the warp yarn B even further improve the abrasion resistance performance of the fabric. Accordingly, a preferred embodiment of the invention is a fabric wherein the high performance fiber of the weft yarn and the warp yarn B are individually selected from the group comprising aromatic polyamide fibers, liquid crystalline polymer fibers, polybenzimidazoles fibers, polybenzoxazoles fibers, polyarylate fibers, highly oriented polyethylene fibers and highly oriented polypropylene fibers.

Whereas each of the warp yarn B and the weft yarn may provide individually benefit to the mechanical properties of the fabric, it was surprisingly found that the total amount of high performance fiber in the yarns present in the inside layer, i.e. the weft yarn and the warp yarn B, increases the abrasion resistance of the fabric. Hence, in a preferred embodiment, the amount of the high performance fiber in the weft yarn and the warp yarn B is at least 10 wt %, preferably at least 30 wt %, more preferably at least 50 wt %, even more preferably at least 70 wt % and most preferably at least 80 wt %, wherein the wt % is the ratio of the cumulative weight of high performance fiber comprised in the weft yarn and warp yarn B to the cumulative weight of the weft yarn and the warp yarn B.

In a yet preferred embodiment, the fabric of the invention comprises the warp yarn B comprising UHMWPE fibers and the weft yarn comprising aromatic polyamide fibers. It was surprisingly found that this specific combination of high performance fibers in the individual warp yarn and weft yarn gives an improved or an optimal balance between wearing comfort of the fabric and its abrasion resistance. Preferably in this embodiment, the warp yarn A substantially consists of a natural fibre, preferably cotton.

The fabric according to the present invention preferably comprises the warp yarn A that substantially consists of cotton, the warp yarn B that is a spun yarn substantially consisting of UHMWPE staple fibers and the weft yarn that substantially consists of continuous UHMWPE filaments. Such a composition results in optimized balance between or in improved wearing comfort and abrasion resistance of the fabric according to the present invention.

The yarns present in the fabric may each individually comprise at least one additive selected from the group comprising pigment, dyes, flame retardants, antioxidants and/or a combination thereof. As commonly practiced in the art, such additives can be used to overcome deficiencies of the woven fabric despite the above cited material and technology choices. The additives can be applied to the fabric by for example impregnation or coating of the fibers, yarns or fabrics at different stages in the production process as well as added to the synthetic fiber(s) during their synthesis process. Such additives are well known in the art. The skilled person can readily select any suitable combination of additives and additive amounts without undue experimentation. The amount of additives depends on their type and function. Typically, their amounts will be from 0 to 20 wt % based on the total composition of the fabric.

A further advantage of the fabric according to the present invention resides in the heterogeneous nature of the employed materials. For example, the hydrophilic character of the natural fiber as well some synthetic fibers comprised in the fabric may be beneficial to adsorb additives such as dyes and pigments, whereas the hydrophobic nature of for example the polyolefin fiber may be favorable to the affinity of the fabric to especially antioxidants and flame retardants.

A fabric according to the invention is excellently suitable for manufacturing of clothing, lining, sport apparel, gloves, curtains, upholstery fabric and floor covering. Preferably the fabric according to the invention is used for the manufacturing of work clothing and leisure clothing where good abrasion properties are required for comfortable and light clothes. Hence further embodiments of the invention are the use of the fabric of the invention in the manufacture of clothing, lining, sport apparel, gloves, curtains, upholstery fabric and floor covering. A further embodiment of the invention are products comprising the fabric according to the invention wherein said product is selected from a group comprising clothing, lining, sport apparel, gloves, curtains, upholstery fabric and floor covering.

The invention also directs to a woven fabric comprising a weft yarn and at least two warp yarns A and B, wherein the weft yarn comprises a high performance fiber; the warp yarn A comprises at least 50 wt % of a natural fiber; the warp yarn B comprises a high performance fiber; and wherein the fabric has an outside layer comprising the warp yarn A and an inside layer comprising the warp yarn B and said outside and inside layers being at least partially interconnected by the weft yarn. The components, preferred embodiments and characteristics etc. of such a fabric are as defined herein above.

It is noted that the invention relates to all possible combinations of features recited in the claims. Features described in the description may further be combined.

It is further noted that the term 'comprising' does not exclude the presence of other elements. However, it is also to be understood that a description on a product comprising certain components also discloses a product consisting of these components. Similarly, it is also to be understood that a description on a process comprising certain steps also discloses a process consisting of these steps.

The invention will be elucidated below with the aid of a number of examples without being limited thereto.

EXAMPLES

Test Procedures

Areal density of the fabrics was measured by weighing a 10×10 $cm^2$ square of fabric and multiplying the recorded weight in g by 100.

Fabrics are subjected to an abrasion resistant test according to EN13595-2.

Tenacity is measured on a Zwick tensile tester according to ISO 2062-93(A).

Tensile properties, i.e. strength and modulus, of fibers were determined on multifilament yarns as specified in ASTM D885M, using a nominal gauge length of the fibre of 500 mm, a crosshead speed of 50%/min and Instron 2714 clamps, of type Fibre Grip D5618C. For calculation of the strength, the tensile forces measured are divided by the titre, as determined by weighing 10 meter of fibre; values in GPa are calculated assuming the natural density of the polymer, e.g. for UHMWPE is 0.97 $g/cm^3$.

Experimental Details

Comparative Experiments A (Comp A)

A plain single layer woven fabric A was produced from a single warp yarn and a weft yarn. The warp yarn I consists of a core yarn of commercially available fibers Dyneema® SK62 (440 dtex) with a tenacity of 35 cN/dtex helically surrounded with 3000 turns per meter by a Nm80/2 cover yarn from cotton. The fabric consists of 29 wt % Dyneema® SK62 and 71 wt % cotton, based on the total yarn composition. The weft yarn was a spun cotton yarn II. The obtained fabric corresponds to the fabrics as disclosed in US2007/0249250.

The plain weave has been subjected to the abrasion test (EN13595-2). Abrasion test results of the fabric A in the different directions (warp direction, weft direction and 45°) can be found in Table 1.

Comparative Experiment B (Comp B)

A representative piece of fabric B was cut from a commercially available Jeans from the brand HELD. Visual inspection indicated that cotton was used as the single warp yarn and that the weft yarn were made by Kevlar® fibers. The fabric consists of 60 wt % cotton and 40 wt % Kevlar®, based on the total yarn composition. Abrasion test results of the fabric B in the different directions (warp direction, weft direction and 45°) can be found in Table 1.

Examples 1-5

Materials: Different yarns have been employed as warp A, warp B and weft yarns in single layer fabrics:

Yarn I: Core yarn of commercially available fibers Dyneema® SK62 (440 dtex) with a tenacity of 35 cN/dtex helically surrounded with 3000 turns per meter by a Nm80/2 cover yarn from cotton. The fabric consists of 60 wt % cotton and 40 wt % Kevlar®, based on the total yarn composition.

Yarn II: 100% spun cotton yarn (OENe6/1 Nm10/1)

Yarn III: spun yarn from 37 wt % Dyneema® SK75 staples and 63 wt % Nylon 6 staples with a count of Nm17/1

Yarn IV: spun yarn from 100% Dyneema® SK75 staples, count Nm17/1

Yarn V: Alternating weft insertions of Yarn II and Yarn IV

Single layer woven fabrics were produced using double weave beam technology providing 2 warp yarns A and B and a weft yarn in a ⅓ twill arrangement. The specific types of warp yarns A and B and weft yarns in the obtained fabric are shown in the Examples 1-5 in Table 1.

TABLE 1

Abrasion test results according to EN13595-2

| | Warp A | Warp B | Weft | Areal density [g/m$^2$] | In warp direction | In weft direction | In 45° degree | Average |
|---|---|---|---|---|---|---|---|---|
| Comp A | I | — | II | 435 | 3.1 | 0.9 | 1.4 | 1.8 |
| Comp B | II | — | Kevlar ® | 476 | 0.9 | 1.0 | 0.9 | 0.9 |
| Comp C | II | — | IV | 380 | 1.0 | 1.2 | 1.1 | 1.1 |
| Comp D | II | — | V | 380 | 1.6 | 1.2 | 1.5 | 1.5 |
| Ex. 1 | II | III | III | 505 | 1.8 | 1.5 | 1.9 | 1.7 |
| Ex. 2 | II | III | IV | 515 | 3.0 | 1.9 | 2.6 | 2.5 |
| Ex. 3 | II | IV | III | 573 | 4.1 | 2.4 | 2.0 | 2.8 |
| Ex. 4 | II | IV | V | 543 | 2.9 | 1.9 | 2.1 | 2.3 |
| Ex. 5 | II | IV | IV | 511 | 4.1 | 2.6 | 4.1 | 3.6 |

Table 1 shows that the fabric according to the present invention (Ex. 1-5) comprising of a weft yarn and two warp yarns A and B shows high abrasion resistance compared to the fabrics obtained by Comparative experiments (Comp A-D). In addition, it was observed that the production losses were low and the quality of the fabric according to the present invention was high, while maintaining a high level of wearing comfort. These advantages were obtained while using readily available materials for manufacturing the yarns.

The invention claimed is:

1. A woven fabric comprising:

a weft yarn, and at most two warp yarns A and B, wherein the weft yarn comprises a fiber having a tenacity or tensile strength of at least 2.5 N/tex;

the warp yarn A comprises at least 50 wt % of a natural fiber;

the warp yarn B comprises a fiber having a tenacity or tensile strength of at least 2.5 N/tex; and wherein the fabric has an outside layer comprising the warp yarn A and an inside layer comprising the warp yarn B and said outside and inside layers being at least partially interconnected by the weft yarn.

2. The fabric of claim 1, wherein the natural fiber is cotton or wool.

3. The fabric of claim 1, wherein the warp yarn B comprises at least 1 wt % of the fiber having a tenacity or tensile strength of at least 2.5 N/tex.

4. The fabric of claim 1, wherein the weft yarn comprises at least 10 wt % of the fiber having a tenacity or tensile strength of at least 2.5 N/tex.

5. The fabric of claim 1, wherein warp yarn A further comprises synthetic fibers of polyamides, polyesters, polytetrafluoroethylene, polyolefins, polyvinyl alcohols and polyacrylonitriles; and/or fibers having a tenacity or tensile strength of at least 2.5 N/tex; and/or other natural fibers than cotton, hemp, wool, silk, jute, linen.

6. The fabric of claim 1, wherein the fibers having a tenacity or tensile strength of at least 2.5 N/tex of the weft yarn and the warp yarn B are individually at least one selected from the group consisting of aromatic polyamide fibers, liquid crystalline polymer fibers, polybenzimidazoles fibers, polybenzoxazoles fibers, polyarylate fibers, highly oriented polyethylene fibers and highly oriented polypropylene fibers.

7. The fabric of claim 1, wherein the amount of the fiber having a tenacity or tensile strength of at least 2.5 N/tex in the weft yarn and the warp yarn B is at least 10wt % wherein the wt % is a ratio of cumulative weight of fiber having a tenacity or tensile strength of at least 2.5 N/tex which is present in the weft yarn and warp yarn B to cumulative weight of the weft yarn and the warp yarn B.

8. The fabric of claim 1, wherein the warp yarn B is a spun yarn.

9. The fabric of claim 1, wherein the weft yarn is a continuous filament yarn.

10. The fabric of claim 1, wherein the warp yarn B further comprises at least one fiber selected from the group consisting of cotton fibers, hemp fibers, wool fibers, silk fibers, jute fibers, linen fibers, polyamide fibers, polytetrafluoroethylene fibers, polyester fibers, polyolefin fibers, polyvinyl alcohol fibers and polyacrylonitriles fibers.

11. The fabric of claim 1, wherein the weft yarn further comprises at least one fiber selected from the group consisting of cotton fibers, hemp fibers, wool fibers, silk fibers, jute fibers, linen fibers, polyamide fibers, polytetrafluoroethylene fibers, polyester fibers, polyolefin fibers, polyvinyl alcohol fibers and polyacrylonitriles fibers.

12. The fabric of claim 1, wherein the warp yarn B comprises ultrahigh molecular weight (UHMWPE) fibers and the weft yarn comprises aromatic polyamide fibers.

13. The fabric of claim 1, wherein the warp yarn A consists essentially of cotton, the warp yarn B is a spun yarn consists essentially of ultrahigh molecular weight (UHMWPE) staple fibers and the weft yarn consists essentially of continuous UHMWPE filaments.

14. The fabric of claim 1, wherein the amount of the fiber having a tenacity or tensile strength of at least 2.5 N/tex in the weft yarn and the warp yarn B is at least 30 wt %.

15. The fabric of claim 1, wherein the amount of the fiber having a tenacity or tensile strength of at least 2.5 N/tex in the weft yarn and the warp yarn B is at least 50 wt %.

16. The fabric of claim 1, wherein the amount of the fiber having a tenacity or tensile strength of at least 2.5 N/tex in the weft yarn and the warp yarn B is at least 70 wt %.

17. The fabric of claim 1, wherein the amount of the fiber having a tenacity or tensile strength of at least 2.5 N/tex in the weft yarn and the warp yarn B is at least 80 wt %.

18. The fabric of claim 1, wherein the warp yarn B comprises ultrahigh molecular weight (UHMWPE) staple fiber.

19. A product comprising the fabric according to claim 1, wherein the product is selected from a group consisting of clothing, lining, sport apparel, gloves, curtains, upholstery fabric and floor covering.

* * * * *